US007753481B2

(12) United States Patent
Kawamata et al.

(10) Patent No.: US 7,753,481 B2
(45) Date of Patent: Jul. 13, 2010

(54) IMAGE RECORDING APPARATUS

(75) Inventors: Noriyuki Kawamata, Nagoya (JP); Toshio Sugiura, Anjo (JP)

(73) Assignee: Brother Kogyo Kabushiki Kaisha, Nagoya-shi, Aichi-ken ( * ) Notice: Subject to any disclaimer, the term of this patent is extended or adjusted under 35 U.S.C. 154(b) by 860 days.

(21) Appl. No.: 11/620,272

(22) Filed: Jan. 5, 2007

(65) Prior Publication Data

US 2007/0159509 A1 Jul. 12, 2007

(30) Foreign Application Priority Data

Jan. 6, 2006 (JP) ..... 2006-001203

(51) Int. Cl.
*B41J 23/00* (2006.01)

(52) U.S. Cl. ..... 347/37

(58) Field of Classification Search ..... 347/37, 347/84; 400/285.5, 313, 315, 329, 355
See application file for complete search history.

(56) References Cited

U.S. PATENT DOCUMENTS 5,751,300 A * 5/1998 Cowger et al. ..... 347/6
6,220,700 B1 * 4/2001 Haigo ..... 347/85

FOREIGN PATENT DOCUMENTS

| | | | |
|---|---|---|---|
| JP | 6320835 | A | 11/1994 |
| JP | 9109508 | A | 4/1997 |
| JP | 2002011918 | A | 1/2002 |
| JP | 2003011340 | A | 1/2003 |

* cited by examiner

*Primary Examiner*—Lamson D Nguyen
(74) *Attorney, Agent, or Firm*—Baker Botts, LLP.

(57) ABSTRACT

An image recording apparatus includes a recording head, a carriage mounted with the recording head and reciprocates in a reciprocation direction, a conductive wire extending from the carriage, a regulating wall which extends along a reciprocation direction of the carriage and suppresses the conductive wire from swelling in a direction separating away from the carriage, and a fixing member which fixes other end side of the conductive wire to an apparatus body by forming a curved portion inverted in the reciprocation direction of the carriage at a predetermined position between the regulating wall and the carriage in the conductive wire and pressing the other end side of the conductive wire toward the regulating wall.

7 Claims, 13 Drawing Sheets

IMAGE RECORDING APPARATUS

CROSS-REFERENCE TO RELATED APPLICATION

This application claims priority from Japanese Patent Application No. 2006-001203, filed on Jan. 6, 2006, the entire subject matter of which is incorporated herein by reference.

TECHNICAL FIELD

Aspects of the present invention relate to an image recording apparatus, in which a conductive wire for transmitting a recording signal is connected to a carriage that is mounted with a recording head for recording an image on a recording medium and reciprocates in a direction intersecting a transport direction of the recording medium so as to follow the reciprocation of the carriage.

BACKGROUND

As an image recording apparatus for recording an image on a recording medium by ejecting ink thereto on the basis of an input signal, an image recording apparatus for supplying ink to an actuator of a recording head and pressurizing and ejecting ink by the use of a warping of the actuator such as a piezoelectric element and an electrostriction element or local boiling of ink by a heating element has been known.

For example, in an image recording apparatus called a serial printer, a recording head is mounted on a carriage reciprocating in the direction perpendicular to a transport direction of a recording medium. The carriage reciprocates to perform an image recording operation every time when the recording medium is transported with a predetermined line-feed length. In order to control the recording head, a flexible conductive wire called a flat cable is connected to the carriage. The flat cable has a length enough to follow the reciprocation of the carriage so as not to hinder the reciprocation of the carriage and is curved in a substantial U shape between the carriage and a main board (for example, see JP-A-6-320835).

FIG. 13 is a diagram illustrating a carriage 90 and a flat cable 91 of a conventional image recording apparatus. The carriage 90 reciprocates in the direction perpendicular to the transport direction of a recording sheet and an image is recorded on the recording medium by ejecting ink from a recording head not shown. The flat cable 91 for transmitting and receiving an electrical signal to and from the main board is connected to the carriage 90. An end 92 of the flat cable 91 is fixed to a frame not shown and is wired to the main board from the end 92. Although not shown in the figure, the carriage 90 is supported by a guide member such as a guide shaft or a guide rail and supplied with a driving force from a belt driving mechanism, etc.

As shown in the figure, the flat cable 91 is drawn out substantially in a horizontal direction from the carriage 90 and is curved substantially in a U shape. When the carriage 90 reciprocates, the flat cable 91 moves accordingly and the central position of the U-shaped curved portion also moves. As indicated by a two-dot chained line in the figure, the posture of the flat cable 91 is changed so that the diameter of the U-shaped curved portion increases when the carriage 90 moves to right and the diameter of the U-shaped curved portion decreases when the carriage 90 moves to left.

Since a decrease in size is required for the image recording apparatus, it is preferable that the space for changing the posture of the flat cable 91 is made as narrow as possible. However, when the flat cable 91 is too close to another member, the flat cable 91 may be damaged due to contact with another member at the time of changing the posture of the flat cable 91. The damage of the flat cable may cause a short-circuit in a conductive wire therein. In addition, a moving speed of the carriage may become unstable due to a load generated from the contact of the flat cable with another member, thereby disturbing the image quality of the recorded image. In order to solve such a problem, means for controlling a movable range of the flat cable 91 at the time of changing the posture thereof has been proposed (for example, see JP-A-9-109508, JP-A-2002-11918 and JP-A-2003-11340).

SUMMARY

In the means for controlling the movable range of the flat cable 91 disclosed in JP-A-9-109508, JP-A-2002-11918 and JP-A-2003-11340, a wall coming in contact with the flat cable 91 is provided. However, as shown in FIG. 13, when the flat cable 91 curved substantially in a U shape is brought into contact with the wall, the opposite curved portion swells in the direction getting away from the wall due to elasticity (bending strength) of the flat cable 91. If the same wall can be provided on the opposite side of the swelling, the movable range of the flat cable 91 is restricted between the opposed walls. However, due to a relation of arrangement in consideration of a member such as a guide frame supporting the carriage 90 or the entire size of the apparatus, it is difficult to secure a space for providing the wall on the opposite side. In addition, the providing of the wall causes an increase in cost.

Aspects of the present invention provide an image recording apparatus that reduces a movable range of a conductive wire following a carriage to decrease the entire size in the image recording apparatus having the carriage reciprocating in a direction intersecting a transport direction of a recording medium.

DETAILED DESCRIPTION

Hereinafter, aspects of the invention will be described with reference to the drawings. The aspects are only examples of the invention and the aspects can be properly modified without departing from the scope of the invention.

Figure 1:
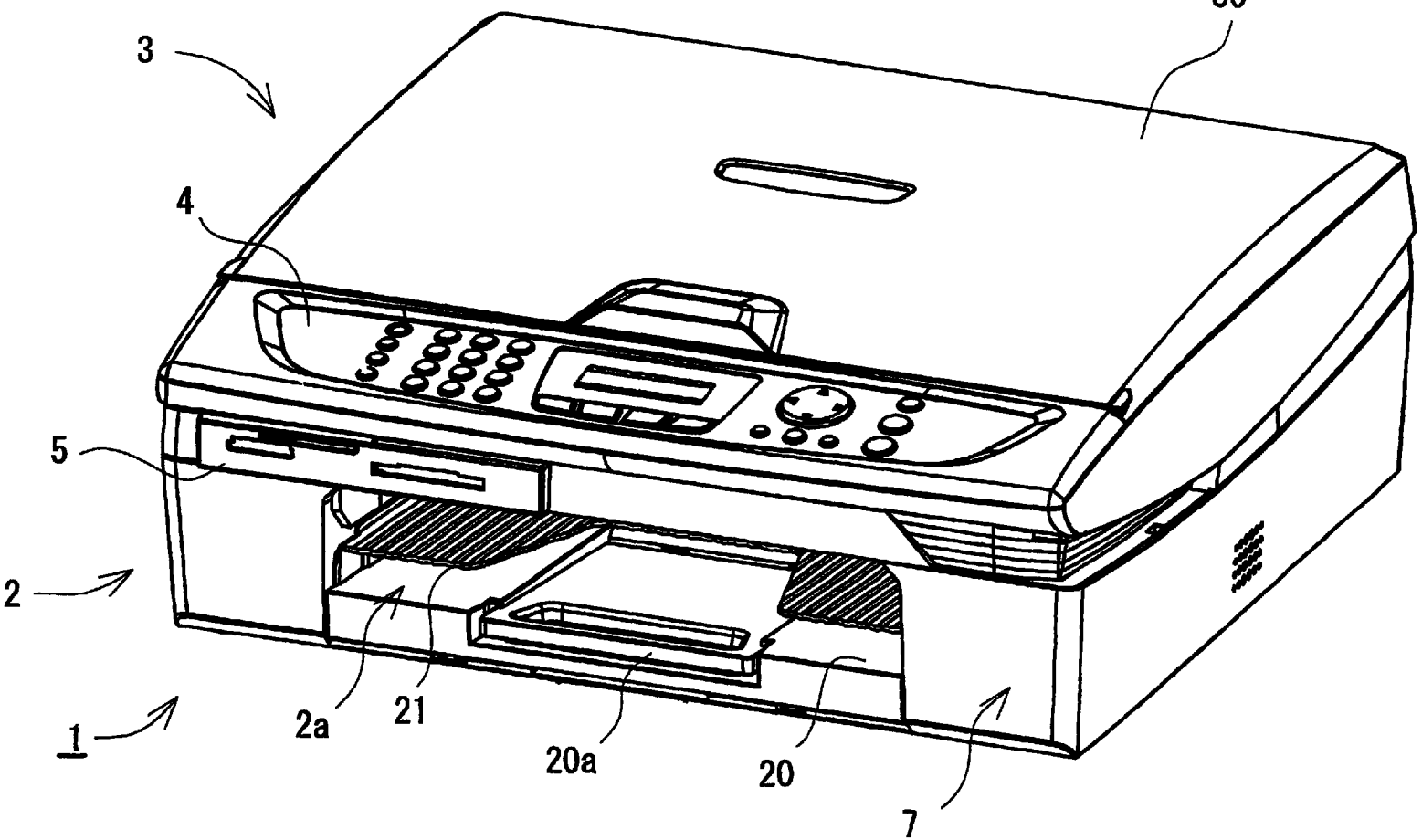
FIG. 1 is a perspective view illustrating an outer configuration of a multifunction apparatus according to an aspect of the invention.
Figure 2:
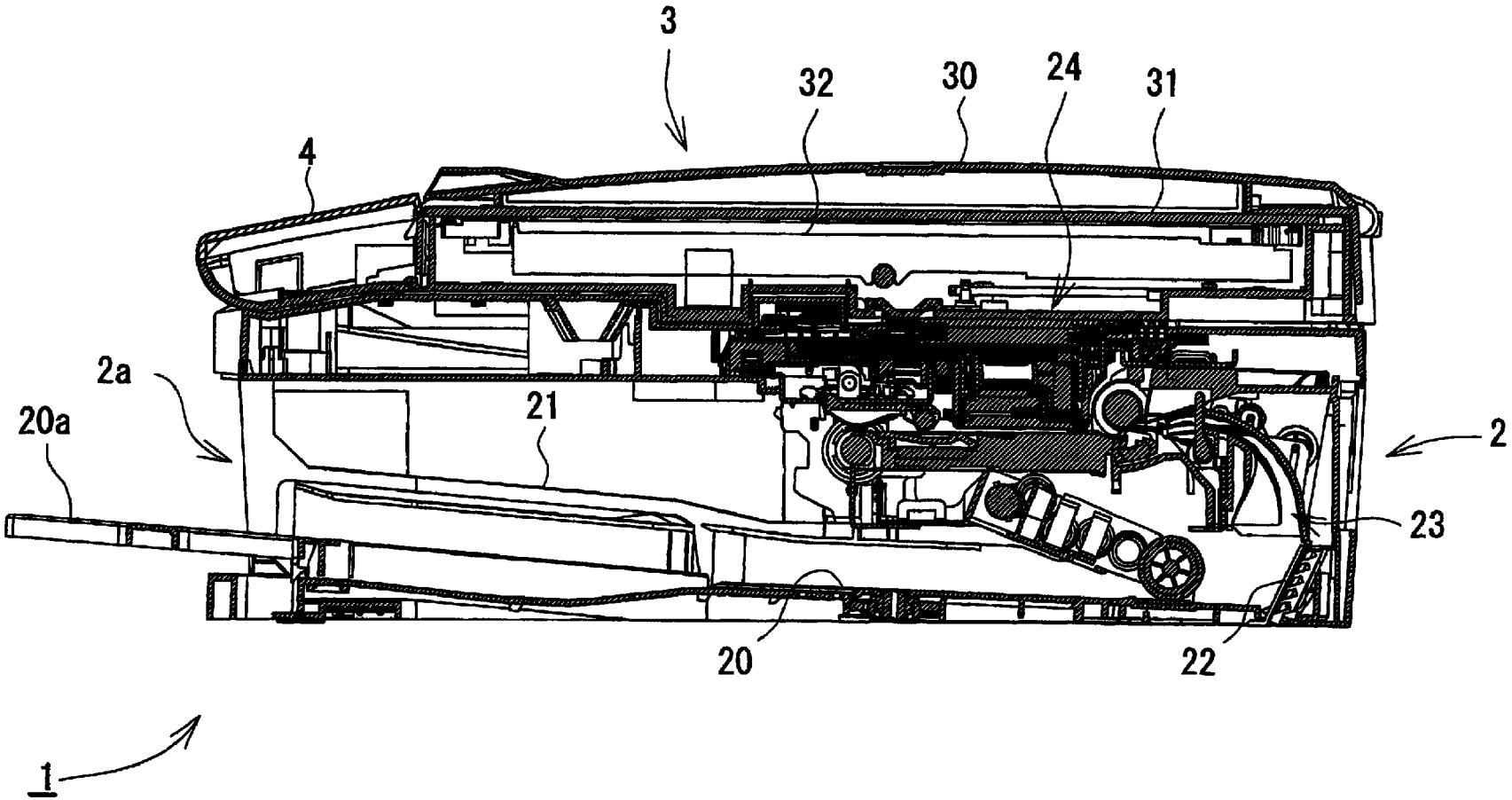
FIG. 2 is a longitudinal sectional view illustrating an inner configuration of the multifunction apparatus.

FIG. 1 is a diagram illustrating an outer configuration of a multifunction apparatus 1 according to an aspect of the invention. FIG. 2 is a longitudinal sectional view illustrating an inner configuration of the multifunction apparatus 1. The multifunction apparatus 1 is a multifunction device (MFD) having a printer unit 2 at the lower side and a scanner unit 3 at the upper side and has a printer function, a scanner function, a copier function, and a facsimile function. The printer unit 2 of the multifunction apparatus 1 corresponds to an image recording apparatus. Accordingly, the functions other than the printer function are optional. The image recording apparatus may be embodied as a mono-functional printer not having a scanner function and a copier function with the scanner unit 3 excluded.

The printer unit 2 of the multifunction apparatus 1 is mainly connected to an external information instrument such as a computer and records images or characters on a recording sheet on the basis of print data including image data or document data transmitted from the computer, etc. The multifunction apparatus 1 may be connected to a digital camera to record image data output from the digital camera on a recording sheet, or may be fitted with a variety of recording media such as a memory card to record image data recorded in the recording mediums on the recording sheet.

As shown in FIG. 1, the multifunction apparatus 1 has a substantial rectangular outer shape of which the width and length are larger than the height and the lower portion of the multifunction apparatus 1 serves as the printer unit 2. An opening 2*a* is formed in the front surface of the printer unit 2. A feed tray 20 and a discharge tray 21 are disposed inside the opening 2*a* to form two vertical stages. Recording sheets as recording media are stored in the feed tray 20 and recording sheets having a size such as a A4 size, a B5 size, or a postcard size are piled therein. As shown in FIG. 2, the tray face of the feed tray 20 is enlarged by drawing out a slide tray 20*a* as needed and thus the recording sheets of legal sizes can be received in the feed tray 20. A recording sheet received in the feed tray 20 is fed into the printer unit 2, an image is recorded thereon, and then the recording sheet is discharged to the discharge tray 21.

The upper portion of the multifunction apparatus 1 serves as the scanner unit 3 which is formed of a so-called flat bead scanner. As shown in FIGS. 1 and 2, a platen glass 31 and an image sensor 32 are disposed below a document cover 30 provided as a top plate of the multifunction apparatus 1. The document cover 30 can be opened and closed. A document of which an image is scanned is placed on the platen glass 31. The image sensor 32 employing the depth direction (the left-right direction in FIG. 2) of the multifunction apparatus 1 as a main scanning direction is disposed below the platen glass 31 so as to reciprocate in the width direction (the direction perpendicular to the sheet plane of FIG. 2) of the multifunction apparatus 1.

An operation panel 4 for operating the printer unit 2 and the scanner unit 3 is provided in the upper front portion of the multifunction apparatus 1. The operation panel 4 includes a variety of operation buttons and a liquid crystal display. The multifunction apparatus 1 operates in accordance with an operating instruction from the operation panel 4. When the multifunction apparatus 1 is connected to an external computer, the multifunction apparatus 1 operates in accordance with an instruction transmitted from the computer through a printer driver or a scanner driver. A slot unit is provided in the upper left portion of the front surface of the multifunction apparatus 1. A variety of small-sized memory cards as memory media can be loaded into the slot unit 5. By performing a predetermined operation to the operation panel 4, image data stored in the small-sized memory card loaded into the slot unit 5 are read out. Information on the read-out image data is displayed on the liquid crystal display and an image can be recorded on a recording sheet by the printer unit 2 on the basis of the displayed information.

An inner configuration of the multifunction apparatus 1, particularly a configuration of the printer unit 2, will now be described with reference to FIGS. 2 to 12. As shown in FIG. 2, a feed tray 20 is disposed in the lower portion of the multifunction apparatus 1 and a separating slope plate 22 is disposed inside the feed tray 20. The separating slope plate 22 separates superposed recording sheets fed from the feed tray 20 and guides the top recording sheet upward. A sheet transport path 23 extends upward from the separating slope plate 22, is bent forward, extends forward from the rear side of the multifunction apparatus 1, and extends to the discharge tray 21 through an image recording unit 24. Accordingly, the recording sheet received in the feed tray 20 is guided upward along the U-shaped sheet transport path 23, is subjected to an image recording by the image recording unit 24, and then is discharged to the discharge tray 21.

Figure 3:
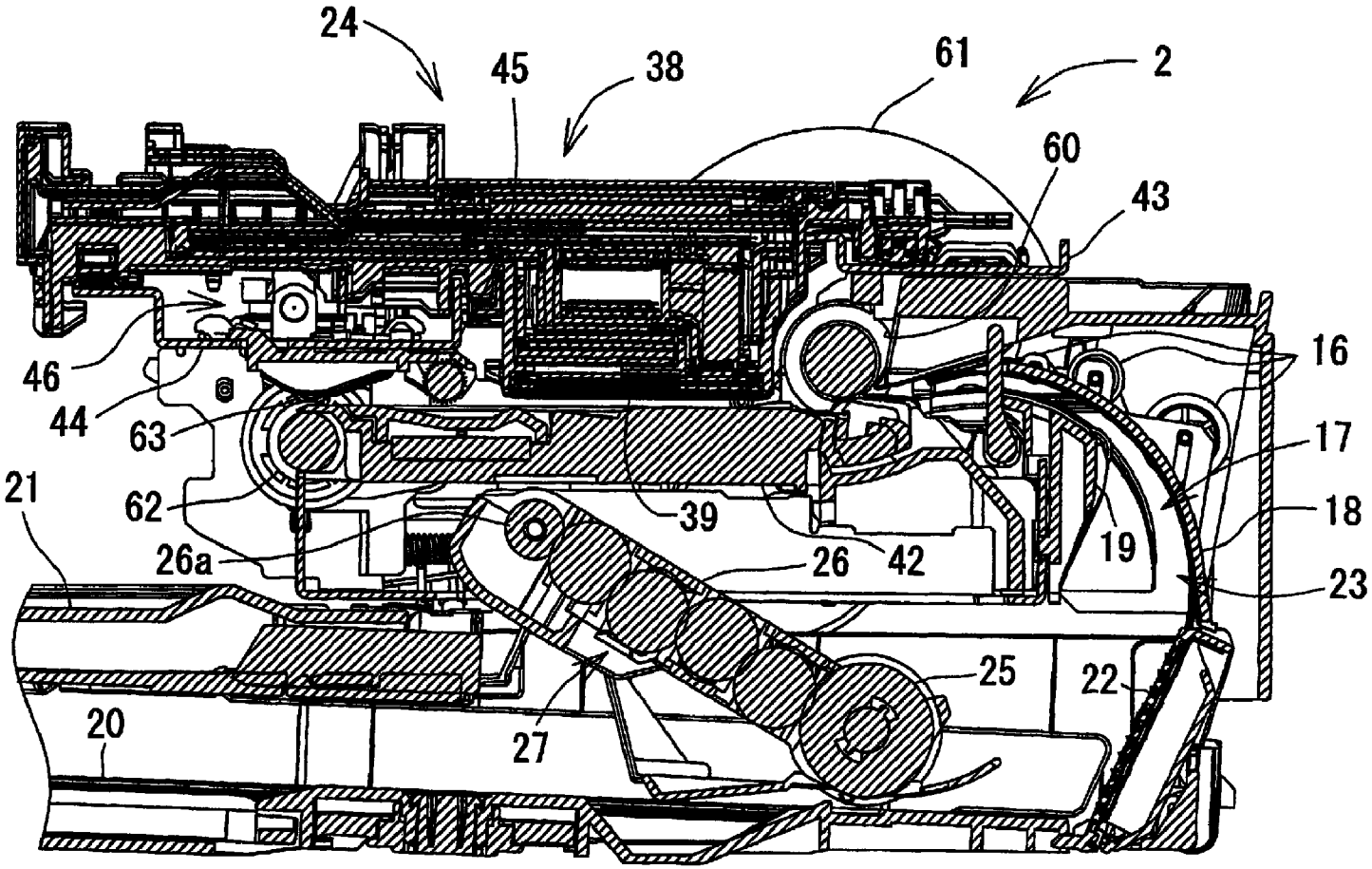
FIG. 3 is an enlarged sectional view illustrating a partial configuration of a printer unit.

FIG. 3 is a partially enlarged sectional view illustrating a partial configuration of the printer unit 2. As shown in FIG. 3, a feed roller 25 for feeding a recording sheet received in the feed tray 20 to the sheet transport path 23 is provided above the feed tray 20. The feed roller 25 is axially supported by an end of a feed arm 26. The feed roller 25 rotates with a driving force delivered from an LF motor 71 (see FIG. 7) through a driving force delivering mechanism 27 in which a plurality of gears meshes with each other.

The feed arm 26 is disposed to be swingable about a base axis 26*a* and vertically moves relative to the feed tray 20. The feed arm 26 is biased by its own weight or by a spring as shown in FIG. 3 so as to contact with the feed tray 20 and can retreat upward at the time of inserting and demounting the feed tray 20. The feed roller 25 axially supported by the end is pressed to the recording sheet on the feed tray 20 with the downward rotation of the feed arm 26. In this state, with the rotation of the feed roller 25, the uppermost recording sheet is sent to the separating slope plate 22 by means of a frictional force between the roller surface of the feed roller 25 and the recording sheet. A leading end of the recording sheet comes into contact with the separating slope plate 22, is guided upward, and is sent to the sheet transport path 23. When the uppermost recording sheet is sent out by the feed roller 25, the next recording sheet may be sent out together by means of friction or static electricity, but the sending of the recording sheet is prevented by the contact with the separating slope plate 22.

The sheet transport path 23 includes an outer guide surface and an inner guide surface with a predetermined gap therebetween, except the position at which the image recording unit 24 is disposed. For example, a curved portion 17 of the sheet transport path 23 on the rear side of the multifunction apparatus 1 is constructed by fixing the outer guide member 18 and the inner guide member 19 to a frame. Particularly, at a position where the sheet transport path 23 is curved, rollers 16 are provided so as to expose the roller surface from the outer guide surface and to be rotatable about the width direction of the sheet transport path 23. The recording sheet sliding on the guide surface is smoothly transported by the rotatable rollers 16 at the position where the sheet transport path 23 is curved.

As shown in FIG. 3, the image recording unit 24 is disposed in the sheet transport path 23. The image recording unit 24 includes a carriage 38 which is mounted with an ink jet recording head 39 and which reciprocates in the main scanning direction. The ink jet recording head 39 is supplied with ink of cyan (C), magenta (M), yellow (Y), and black (Bk) through ink tubes 41 (ink supply tube, see FIG. 4) from an ink cartridge disposed separately from the inkjet recording head 39 in the multifunction apparatus 1. While the carriage 39 reciprocates, an image is recorded on the recording sheet transported on the platen 42 by selectively ejecting the ink of various colors as ink droplets from the ink jet recording head 39. The ink cartridge is not shown in FIGS. 3 and 4.

Figure 4:
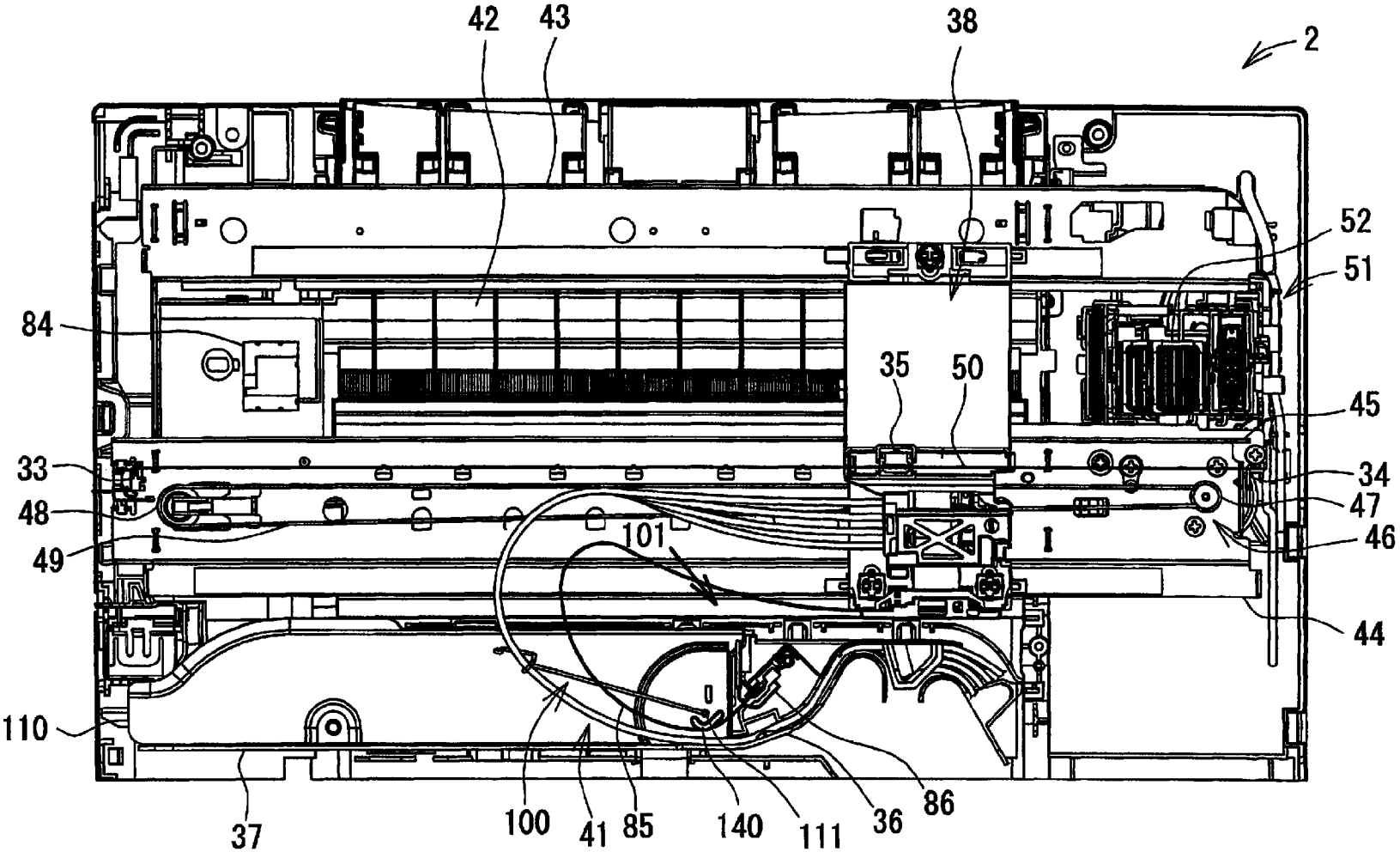
FIG. 4 is a plan view illustrating a partial configuration of the printer unit.

FIG. 4 is a plan view illustrating a partial configuration of the printer unit 2 and illustrates the configuration of the printer unit 2 from the center to the rear surface side. As shown in FIG. 4, above the sheet transport path 23, a pair of guide rails 43 and 44 extends in the direction (the left-right direction in FIG. 4) perpendicular to the transport direction of the recording sheet with a predetermined gap therebetween in the transport direction (the direction from the upside toward the downside in FIG. 4). The guide rails 43 and 44 are disposed in the case of the printer unit 2 and constitute a part of the frame supporting the constituent members of the printer unit 2. The carriage 38 is suspended on the guide rails 43 and 44 and is placed to be slidable in the direction perpendicular to the transport direction of the recording sheet. Since the guide rails 43 and 44 are disposed to be substantially parallel to each other with a gap in the transport direction of the recording sheet, the height of the printer unit 2 is reduced, thereby decreasing the thickness of the printer unit 2.

The guide rail 43 disposed upstream in the transport direction of the recording sheet has a plate shape of which the length in the width direction (the left-right direction in FIG. 4) of the sheet transport path 23 is larger than the reciprocating length of the carriage 38. The guide rail 44 disposed downstream in the transport direction of the recording sheet has a plate shape of which the length in the width direction of the sheet transport path 23 is substantially equal to the length of the guide rail 43. The upstream end of the carriage 38 is placed on the guide rail 43 and the downstream end thereof is placed on the guide rail 44, so that the carriage 38 slides in the longitudinal direction of the guide rails 43 and 44. The upstream edge 45 of the guide rail 44 in the transport direction is bent upward substantially at a right angle. The carriage 38 supported by the guide rails 43 and 44 interposes the edge 45 between interposing members such as a pair of rollers. Accordingly, the carriage 38 is positioned in the transport direction of the recording sheet and is slidable in the direction perpendicular to the transport direction of the recording sheet. That is, the carriage 38 is slidably supported on the guide rails 43 and 44 and reciprocates in the direction perpendicular to the transport direction of the recording sheet relative to the edge 45 of the guide rail 44. Although not shown in the figure, lubricant such as grease is applied to the edge 45 so as to smooth the sliding of the carriage 38.

A belt driving mechanism 46 is disposed on the guide rail 44. In the belt driving mechanism 46, an endless timing belt 49 having teeth therein is suspended between a driving pulley 47 and a driven pulley 48 provided in the vicinity of both ends in the width direction of the sheet transport path 23. A driving force from a CR motor 73 (see FIG. 7) is input to the axis of the driving pulley 47 and the timing belt 49 is circulated with the rotation of the pulley 47. The timing belt 49 is not limited to the endless shape, but may employ an ended belt of which both ends are fixed to the carriage 38.

The bottom of the carriage 38 is fixed to the timing belt 49. Accordingly, the carriage 38 reciprocates on the guide rails 43 and 44 with respect to the edge 45 with the circulation of the timing belt 49. The carriage 38 is mounted with an ink jet recording head 39 and the ink jet recording head 39 reciprocates in the width direction of the sheet transport path 23 as the main scanning direction.

Figure 7:
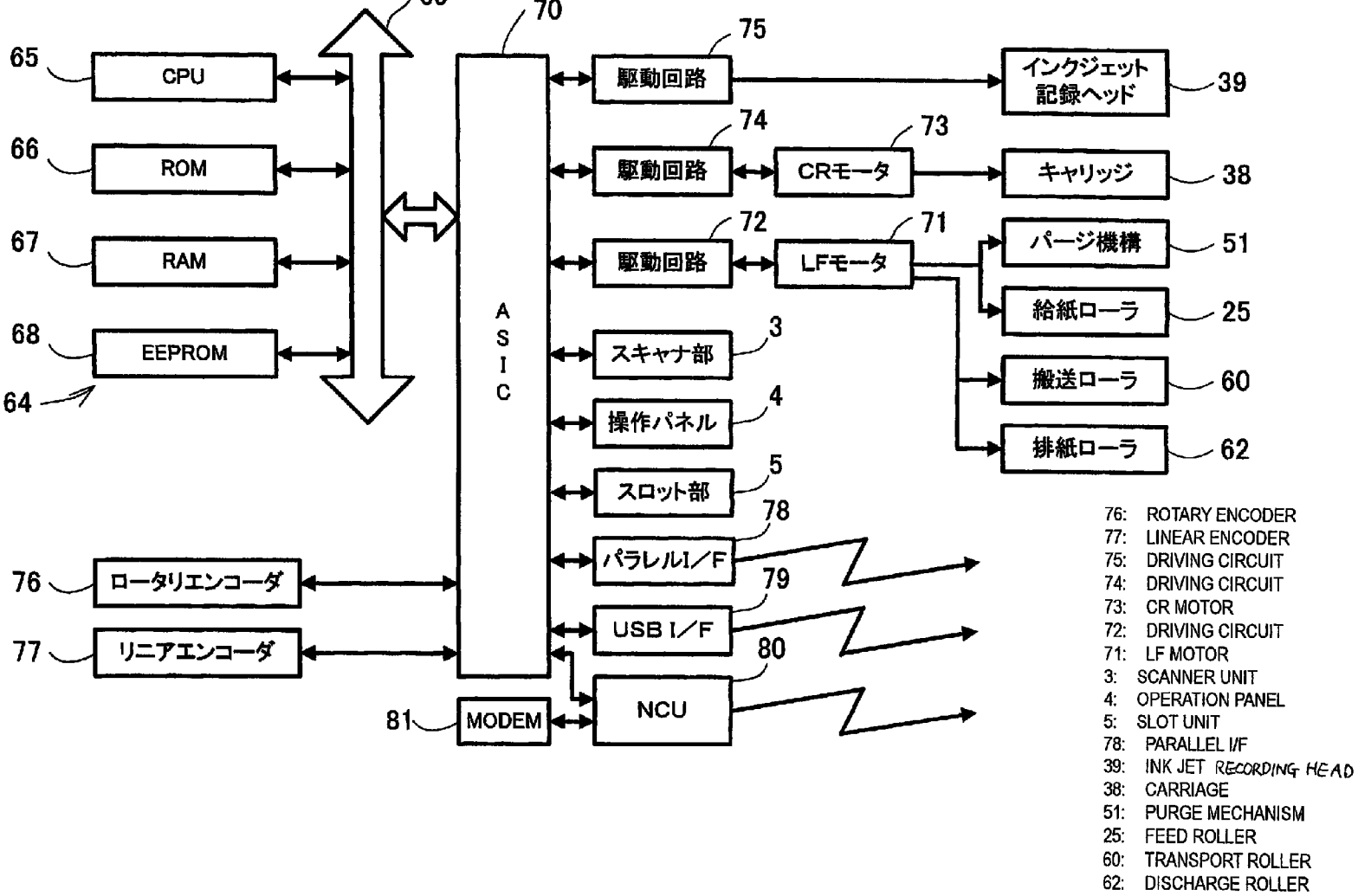
FIG. 7 is a block diagram illustrating a configuration of a controller of the multifunction apparatus.

The guide rail 44 is provided with an encoder strip 50 of a linear encoder 77 (see FIG. 7). The encoder strip 50 has a belt shape formed of a transparent resin. A pair of support portions 33 and 34 is formed on both ends in the width direction (the reciprocation direction of the carriage 38) of the guide rail 44 so as to rise upright from the top surface thereof. Both ends of the encoder strip 50 are locked to the support portions 33 and 34 and are suspended along the edge 45. Although not shown in the figure, one of the support portions 33 and 34 is provided with a spring and the end of the encoder strip is locked by the spring. A tension acts on the encoder strip in the longitudinal direction thereof by means of the spring, thereby preventing looseness. When an external force acts on the encoder strip 50, the spring is elastically deformed, thereby bending the encoder strip 50.

A pattern in which a light transmitting portion transmitting light and a light shielding portion shielding light are disposed alternately in the longitudinal direction with a predetermined pitch is recorded in the encoder strip 50. An optical sensor 35 as a transmissive sensor is provided at a position corresponding to the encoder strip 50 on the top surface of the carriage 38. The optical sensor 35 reciprocates in the longitudinal direction of the encoder strip 50 along with the carriage 38 and senses the pattern of the encoder strip 50 at the time of reciprocating. A head control board controlling the ejection of ink is provided in the inkjet recording head 39. The head control board outputs a pulse signal based on a sensing signal of the optical sensor 35 and the position of the carriage 38 is determined on the basis of the pulse signal, thereby controlling the reciprocation of the carriage 38. In FIG. 4, the head control board is covered with a head cover of the carriage 38, which is not shown in the figure.

As shown in FIGS. 3 and 4, the platen 42 is disposed below the sheet transport path 23 so as to be opposed to the ink jet recording head 39. The platen 42 is disposed over the central portion through which the recording sheet passes in the reciprocating range of the carriage 38. The width of the platen 42 is sufficiently larger than the largest width of the recording sheet to be transported and both ends of the recording sheet always pass through the upper portion of the platen 42.

As shown in FIG. 4, maintenance units such as a purge mechanism 51 and a waste ink tray 84 are disposed in a portion other than the range through which the recording sheet does not pass, that is, the image recording range of the ink jet recording head 39. The purge mechanism 51 sucks and removes bubble or foreign substances from nozzles 53 (see FIG. 5) of the ink jet recording head 39. The purge mechanism 51 includes a cap 52 covering the nozzles 53 of the ink jet recording head 39, a pump mechanism connected to the ink jet recording head 39 through the cap 52, and a movement mechanism for attaching and detaching the cap 52 to and from the ink jet recording head 39. In FIG. 4, the pump mechanism and the movement mechanism are disposed below the guide frame 44 and are not shown in the figure. At the time of sucking and removing bubbles, etc. from the ink jet recording head 39, the carriage 38 moves so that the ink jet recording head 39 is located above the cap 52. In this state, the cap 52 moves upward and comes into close contact with the bottom surface of the ink jet recording head 39 so as to seal the nozzles 53. By allowing the inside of the cap 52 to have a negative pressure by means of the pump mechanism, ink is sucked from the nozzles 53 of the ink jet recording head 39. The bubbles or foreign substances in the nozzles 53 are sucked and removed along with the ink.

The waste ink tray 84 serves to receive the ink ejected from the ink jet recording head 39, which is called a flushing operation. The waste ink tray 84 is disposed inside the reciprocating range of the carriage 38 and outside the image recording range on the top surface of the platen 42. A felt is disposed in the waste ink tray 84 and the flushed ink is absorbed and retained by the felt. Maintenances such as removal of bubbles or color-mixed ink and prevent of dry in the ink jet recording head 39 are carried out by the maintenance units.

As shown in FIG. 1, a door 7 is provided in the front surface of the case of the printer unit 2 so as to be opened and closed. When the door 7 is opened, a cartridge mounting unit is exposed from the front surface and thus the ink cartridge can be pulled out or pushed in. The cartridge mounting unit is partitioned into four reception chambers corresponding to the number of ink cartridges and the ink cartridges storing ink of cyan, magenta, yellow, and black are received in the reception chambers. Four ink tubes 41 (ink supply tubes) corresponding to the ink colors are drawn from the cartridge mounting unit to the carriage 38. The color ink is supplied to the ink jet recording head 39 mounted on the carriage 38 from the ink cartridges mounted on the cartridge mounting unit through the ink tubes 41.

The ink tubes 41 are made of a synthetic resin and have flexibility capable of being bent with the reciprocation of the carriage 38. The ink tubes 41 drawn out from the cartridge mounting unit extend to the center in the width direction and are fixed to an end of a fixing clip 36 on an apparatus body. The portions of the ink tubes 41 from the fixing clip 36 to the carriage 38 are not fixed to the apparatus body and change their postures with the reciprocation of the carriage 38. The ink tubes 41 extending from the fixing clip 36 to the cartridge mounting unit are omitted in FIG. 4.

As shown in FIG. 4, the portions of the ink tubes 41 from the fixing clip 36 to the carriage 38 are drawn out to form a curved portion inverted in the reciprocation direction of the carriage 38. In other words, the ink tubes 41 are drawn out to substantially form a U shape in a plan view. Four ink tubes 41 are arranged horizontally in the transport direction of the recording sheet on the carriage 38 and extend in the reciprocation direction of the carriage 38. On the other hand, four ink tubes 41 are arranged and fixed to the fixing clip 36 in a state where they are vertically stacked. Accordingly, four ink tubes 41 are curved in a U shape as a whole while being twisted so as to change the horizontal arrangement to the vertical arrangement from the carriage 38 to the fixing clip 36.

Four ink tubes 41 have substantially the same length from the carriage 38 to the fixing clip 36. The ink tube 41 disposed most upstream in the transport direction of the recording sheet at the carriage 38 is disposed on the uppermost side in the fixing clip 36. The ink tube 41 disposed most next to the upstream ink tube 41 is disposed on the lower side next to the ink tube 41 in the fixing clip 36. In this way, the ink tubes 41 are sequentially disposed from the uppermost side to the lower side in the fixing clip 36 in the order of the ink tubes from most upstream to downstream in the transport direction of the recording sheet at the carriage 38. Since the lengths of the ink tubes 41 are substantially equal to each other, the centers of the U-shaped curved portions of the ink tubes 41 are curved eccentrically in the transport direction of the recording sheet. Accordingly, four ink tubes 41 are arranged obliquely from the upside to the downside in the curved portions and the interference of the ink tubes 41 with each other is prevented at the time of changing the posture with the movement of the carriage 38. In this aspect, four ink tubes 41 are described, but the number of ink tubes may be increased. The ink tubes 41 are sequentially arranged on the side of the fixing clip in the order of the ink tubes arranged upstream to downstream in the transport direction of the recording sheet at the carriage 38.

Recording signals, etc. are transmitted from a main board constituting a controller 64 (see FIG. 7) to the head control board of the ink jet recording head 39 through a flat cable 85 (conductive wire). The main board is disposed on the front side of the apparatus (the front side in FIG. 4) and is not shown in FIG. 4. The flat cable 85 has a thin belt shape in which a plurality of conductive wires transmitting electric signals are coated with a synthetic resin film such as a polyester film for insulation and electrically connects the head control board to the main board.

The flat cable 85 has a flexibility allowing the flat cable to be curved with the reciprocation of the carriage 38. As shown in FIG. 4, a portion (non-fixed portion) of the flat cable 85 from the carriage 38 to a fixing clip 86 (fixing member) is drawn out to form a curved portion inverted in the reciprocation direction of the carriage 38. In other words, the flat cable 85 is drawn out to form a substantial U shape in a plan view with both surfaces of the thin belt shape extended vertically. That is, the normal line of the front and rear surfaces of the flat cable 85 are horizontal and the surfaces extend vertically. The direction in which the flat cable 85 extends from the carriage 38 and the direction in which the ink tubes 41 extend are substantially the same as the reciprocation direction of the carriage 38.

One end of the flat cable 85 fixed to the carriage 38 is electrically connected to the head control board mounted on the carriage 38. The other end of the flat cable 85 fixed to the fixing clip 86 is electrically connected to the main board. The non-fixed portion of the flat cable 85 which is curved in a U shape changes its posture with the reciprocation of the carriage 38, similarly to the ink tubes 41. The ink tubes 41 and the flat cables 85 changing the posture with the reciprocation of the carriage 38 are supported by a swingable support member 100.

Figure 8:
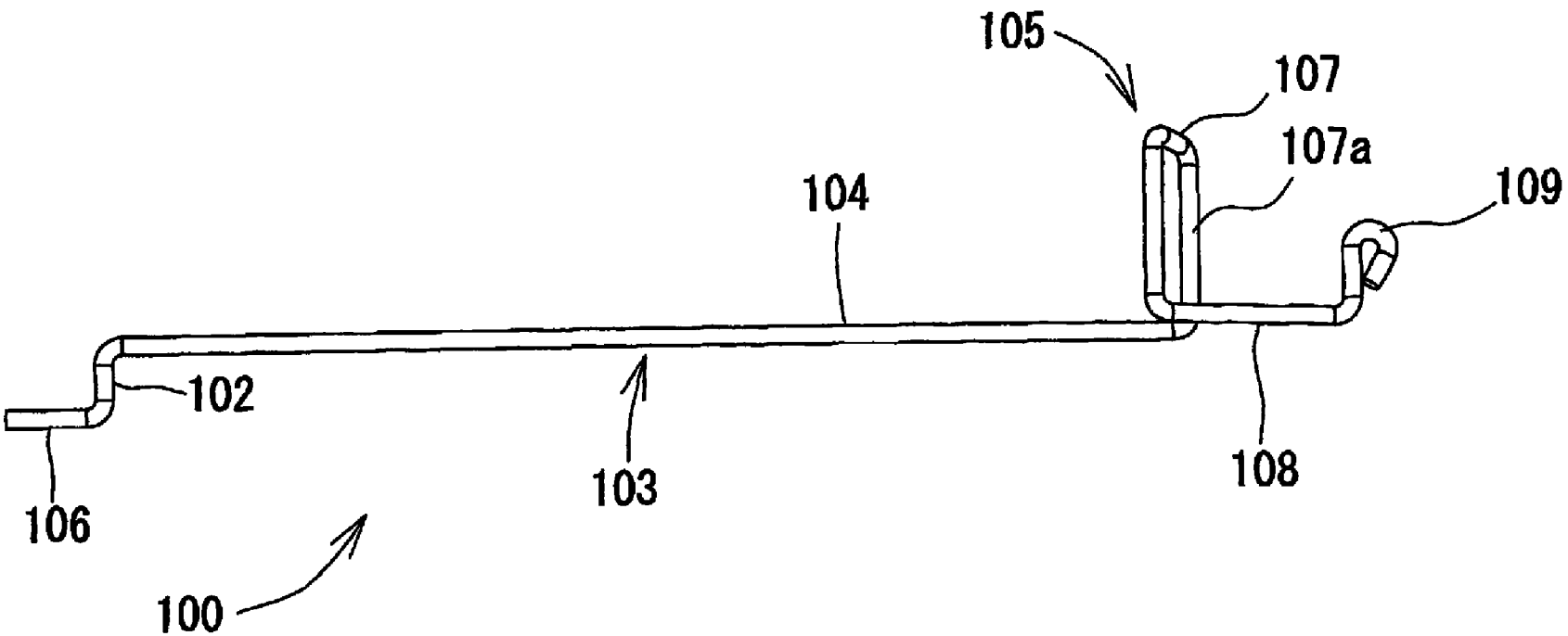
FIG. 8 is a front view illustrating a configuration of a swingable support member 100.

FIG. 8 is a front view illustrating a configuration of the swingable support member. As shown in FIG. 8, the swingable support member 100 includes a pivot portion 102 serving as a pivot, an arm 103 extending from the pivot portion 102, a carrying portion 104 formed on a base end side of the arm 103, a supporting portion 105 formed on a free end side of the arm 103, and an assistant arm 106 extending from the pivot portion 102 to form a crank shape with the pivot portion 102 and the arm 103. The swingable support member is formed by bending a wire material.

The pivot portion 102 and the arm 103 are bent substantially at a right angle and the pivot portion 102 is inserted into a pivot hole 111 of a supporting board 110 fixed to the apparatus body as shown in FIG. 4. Accordingly, the pivot portion 102 is axially supported substantially in the vertical direction and the arm 103 extends substantially in the horizontal direction. The pivot portion 102 is slidable with respect to the pivot hole 111 and the arm 103 swings about the pivot portion 102. The supporting board 110 is fixed to the apparatus body between a regulating wall 37 to be described later and the guide rail 44 as shown in FIG. 4.

The top surface of the arm 103 extending in the horizontal direction serves as the carrying portion 104 for carrying the flat cable 85. The carrying portion 104 comes into contact with the bottom surface of the flat cable 85 of which the front and rear surfaces extend in the vertical direction. The flat cable 85 slides on the carrying portion 104 at the time of changing its posture with the reciprocation of the carriage 38. Accordingly, the length of the arm 103 forming the carrying portion 104 is set so that the carrying portion 104 can slidably carry the flat cable 85 in the reciprocation range of the carriage 38.

The supporting portion 105 formed on the free end side of the arm 103 supports the ink tubes 41. The supporting portion 105 includes a ring portion 107 having a vertically longitudinal rectangular shape, a lower end portion protruding from the ring portion 107 to the free end, and a curved portion 109 formed at the free end of the lower end portion 108. The inner width of the ring portion 107 is equal to the outer diameter of the ink tubes 41 and the inner height thereof is four times the outer diameter of the ink tubes 41, that is, the height of four ink tubes 41 vertically arranged. The ring portion 107 is formed by bending the wire material forming the swingable support member 100 so as to rise upright from the arm 103 and then bending the wire material so as to form a vertically longitudinal rectangular shape. The lower end portion of the ring portion 107 extends substantially horizontally in the extending direction of the arm 103. The end of the lower end portion 108 is bent upward and then is curved in an arc shape outwardly in the extending direction of the arm 103, thereby forming the curved portion 109.

Four ink tubes 41 are inserted into the ring portion 107 of the supporting portion 105 and supported by the lower end portion 108, whereby a predetermined portion of the ink tubes 41 are slidably supported by the supporting portion 105. The ring portion 107 surrounds four ink tubes 41 and maintains the vertical arrangement fixed to the fixing clip 36. Accordingly, four ink tubes 41 do not independently and widely swing at the time of changing postures with the reciprocation of the carriage 38 and the postures thereof are changed as a whole in a state where the vertical arrangement is supported at the predetermined portion. The ink tubes 41 is slidable in the extending direction while being surround with the ring portion 107 and an excessive load is not generated in the ink tubes 41 by allowing the ink tubes 41 to appropriately slide on the ring portion 107 at the time of changing the postures of the ink tubes 41. On the other hand, the change of posture of the ink tubes 41 is delivered as a rotary power of the swingable support portion 100 by means of the friction between the ink tubes 41 and the ring portion 107.

Four ink tubes 41 surrounded with the ring portion 107 is carried by the lower end portion 108 on the end side of the ring portion 107 and slide on the lower end portion 108 on the end side of the ring portion 107 with the change of posture following the carriage 38. That is, the ink tubes 41 are slidable on the lower end portion 108 between the ring portion 107 and the curved portion 109. Since the end of the lower end portion 108 is bent upward to form the curved portion 109, the ink tubes 41 are prevented from departing from the lower end portion 108. Since the curved portion 109 is curved in an arc shape outwardly in the extending direction of the arm 103, the end or the sharp tip of the wire material does not come into contact with the ink tubes 41. Accordingly, damages on the ink tubes 41 are prevented.

The assistant arm 106 abuts the surrounding of the pivot hole 111 in the bottom surface of the supporting board 110. Accordingly, the pivot portion 102 is prevented from departing from the pivot hole 111 and the supporting portion 105 on the end side of the arm 103 is prevented from inclining downwardly. Supporting ribs for supporting the arm 103 and the assistant arm 106 may be formed on the top and bottom surfaces around the pivot hole 111 of the supporting board.

The ink tubes 41 and the flat cable 85 changing the posture with the reciprocation of the carriage 38 are supported at a predetermined height by the swingable support member 100. As described above, the ink tubes 41 are supported by the supporting portion 105 and the flat cable 85 is carried by the carrying portion 104. When the ink tubes 41 change the postures with the reciprocation of the carriage 38, the change of posture of the ink tubes 41 is delivered to the arm 103 through the supporting portion 105 and thus the arm 103 swings about the pivot portion 102.

On the front side of the ink tubes 41 and the flat cable 85, a regulating wall 37 extends in the width direction of the apparatus (the left-right direction in FIG. 4). The regulating wall 37 is a wall having a vertical wall surface abutting the ink tubes 41 and rises upright linearly in the reciprocation direction of the carriage 38. The regulating wall 37 extends in the extending direction of the ink tubes 41 from the fixing clip 36 fixing the ink tubes 41 and has a height which can allow all of four ink tubes 41 arranged vertically by the fixing clip 36 to come into contact with the regulating wall.

The ink tubes 41 extend along the regulating wall 37 from the fixing clip 36 and are prevented from swelling toward the front of the apparatus, that is, in the direction getting away from the carriage 38, by coming into contact with a wall surface of the regulating wall 37 on the rear side. Inside the curved portions of the ink tubes 41, the flat cable 85 extending along the regulating wall 37 from the fixing clip 86 is prevented from swelling in the direction getting away from the carriage 38 by the regulating wall 37 with the ink tubes 41 interposed therebetween. That is, the movable range of the ink tubes 41 and the flat cable 85 is regulated by one regulating wall 37. In the state where the ink tubes 41 come into contact with the regulating wall 37 (see FIG. 12), the portions of the ink tubes 41 from the fixing clip 36 to the curved portions are supported in the vertical arrangement in the fixing clip 36. Accordingly, the ink tubes 41 are satisfactorily supported with a desired tilted posture in the U-shaped curved portions. The fixing clips 36 and 86 fix the ink tubes 41 and the flat cable 85 to press them toward the regulating wall 37, the configuration of which will be described later.

Figure 5:
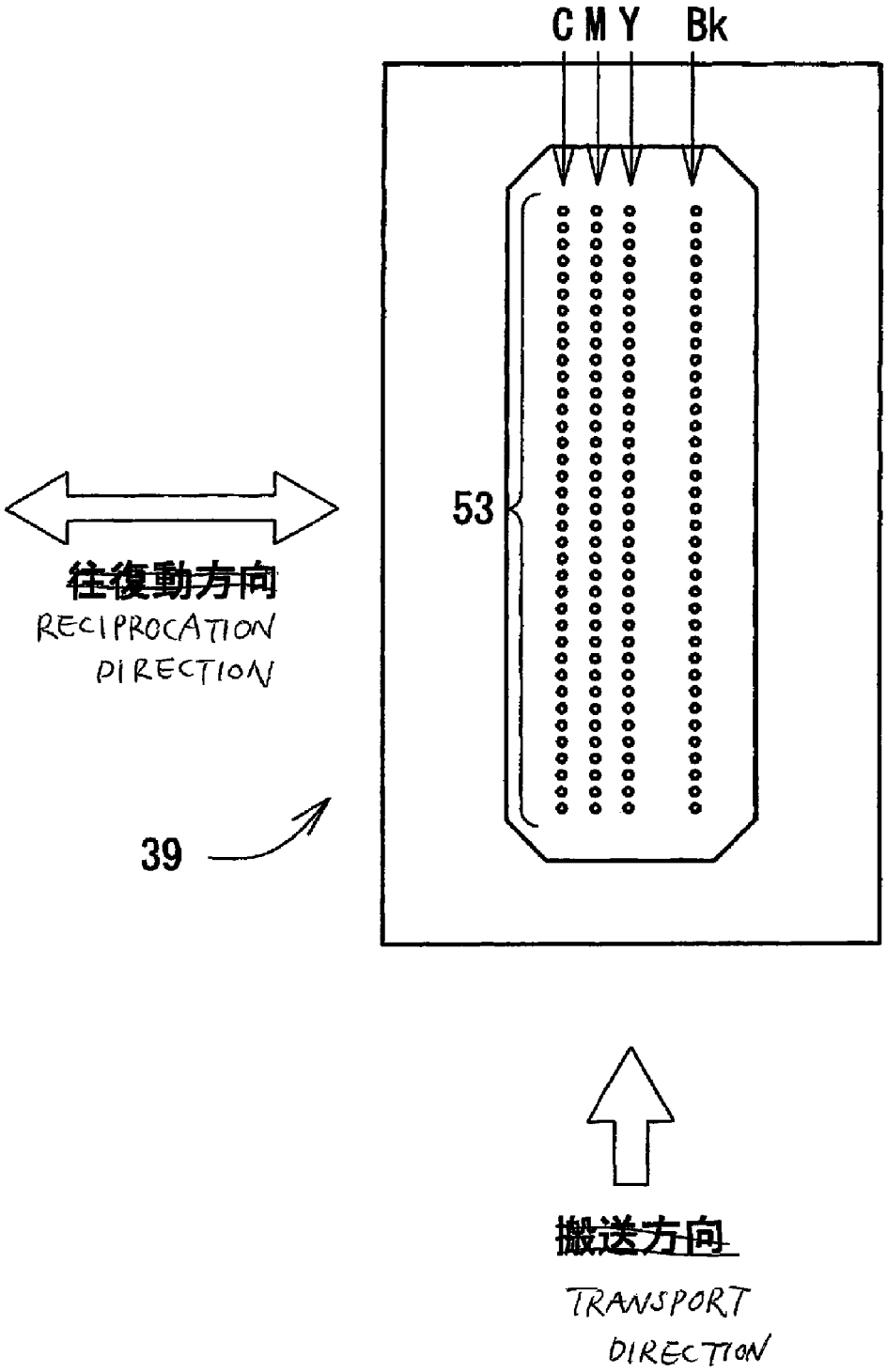
FIG. 5 is a bottom view illustrating a nozzle forming surface of an ink jet recording head.

FIG. 5 is a bottom view illustrating a nozzle forming surface of the ink jet recording head 39. As shown in the figure, nozzles 53 are arranged in lines in the transport direction of the recording sheet on the bottom surface of the ink jet recording head 39 for every color ink of cyan (C), magenta (M), yellow (Y), and black (Bk). In the figure, the vertical direction is the transport direction of the recording sheet and the left-right direction is the reciprocation direction of the carriage 38. The nozzles 53 for each color ink of C, M, Y, and Bk are arranged in a line in the transport direction of the recording sheet and the nozzles 53 for each color ink are arranged in a line in the reciprocation direction of the carriage 38. The pitch or number of the nozzles 53 in the transport direction is appropriately set in consideration of the resolution of the recorded image. The number of lines of the nozzles 53 can be increased or decreased depending on the number of kinds of color ink.

Figure 6:
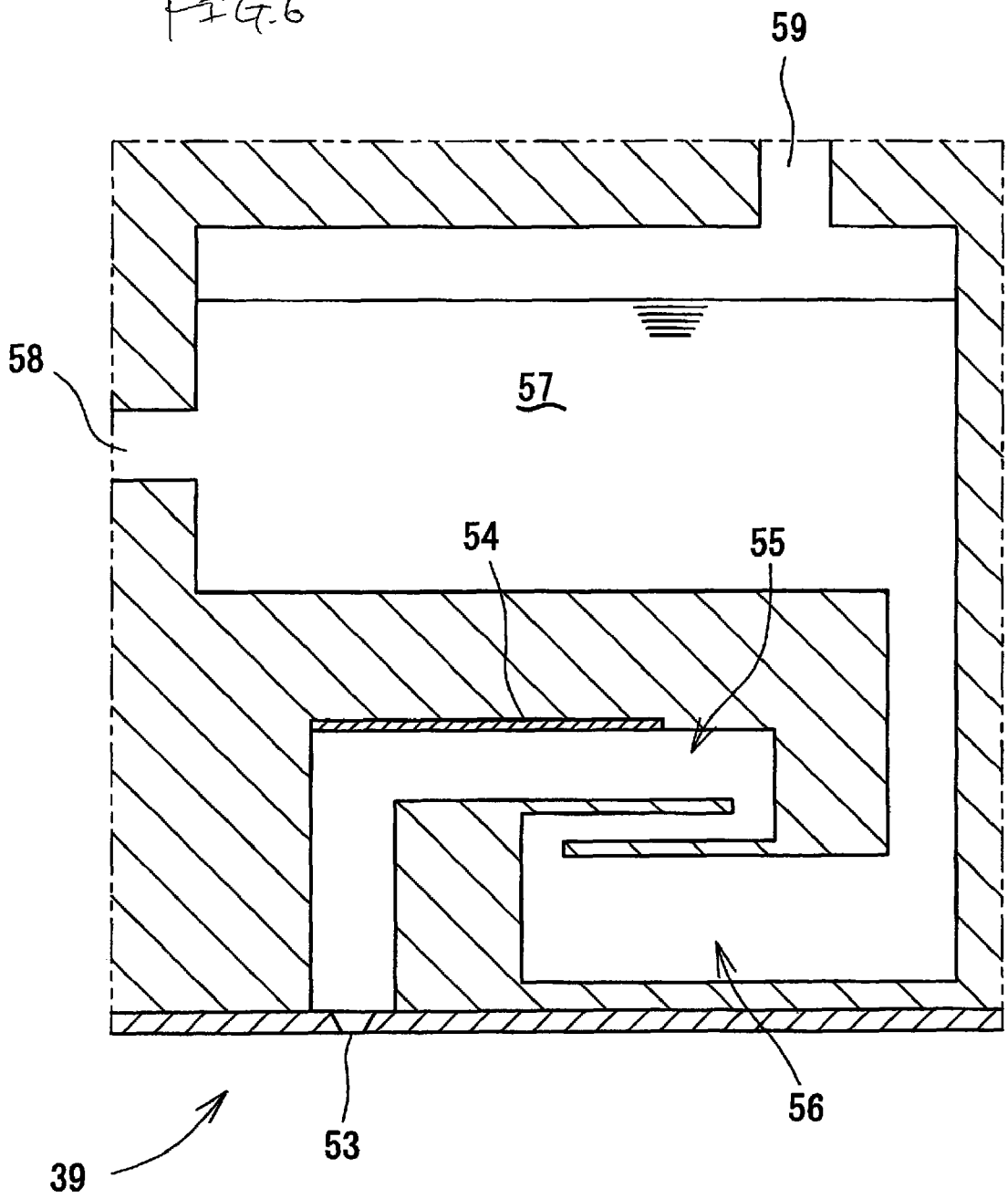
FIG. 6 is a schematic diagram illustrating a sectional configuration of the ink jet recording head.

FIG. 6 is a partially enlarged sectional view illustrating an inner configuration of the ink jet recording head 39. As shown in the figure, a cavity 55 having a piezoelectric element 54 is formed on the upstream side of the nozzles 53 formed in the bottom surface of the ink jet recording head 39. The piezoelectric element 54 is deformed with an application of a predetermined voltage to reduce the volume of the cavity 55.

With the variation in volume of the cavity 55, the ink in the cavity 55 is ejected as ink droplets from the nozzles 53.

The cavity 55 is provided for each nozzle 53 and a manifold 56 is formed over plural cavities 55. The manifold 56 is provided for each color of C, M, Y, and Bk. A buffer tank 57 is disposed on the upstream side of the manifold 55. The buffer tank 57 is provided for each color of C, M, Y, and Bk. Ink flowing through the ink tubes 41 is supplied from an ink supply port 58 to the buffer tank 57. When the ink is once stored in the buffer tank 57, bubbles generated in the ink in the ink tubes 57, etc. are captured, thereby preventing the bubbles from entering the cavities 55 and the manifolds 56. The bubbles captured in the buffer tanks 57 are sucked and removed by the pump mechanism through a bubble discharge port 59. The ink supplied from the buffer tanks 57 to the manifolds 56 is distributed into the cavities 55 by the manifolds 56.

In this way, ink flow channels are formed so as to allow each color ink supplied from the ink cartridges through the ink tubes 41 to flow in the cavities 55 through the manifolds 56. Each color ink of C, M, Y, and Bk supplied through the ink flow channels is ejected as ink droplets to the recording sheet from the nozzles 52 with the deformation of the piezoelectric element 54.

As shown in FIG. 3, a pair of transport roller 60 and pinch roller is provided on the upstream side of the image recording unit 24. In FIG. 3, the pinch roller is covered with another member and is not shown, but is disposed below the transport roller 60 to be pressed thereto. The transport roller 60 and the pinch roller nip the recording sheet transported in the sheet transport path 23 and transports the recording sheet onto the platen 42. A pair of discharge roller 62 and a spur roller 63 is disposed on the downstream side of the image recording unit 24. The discharge roller 62 and the spur roller 63 nip the recording sheet having been subjected to the recording operation and transport the recording sheet to the discharge tray 21. The transport roller 60 and the discharge roller 62 are supplied with a driving force from the LF motor 71 and are driven intermittently with a predetermined linefeed gap. The rotations of the transport roller 60 and the discharge roller 62 are synchronized with each other. A rotary encoder 76 (see FIG. 7) disposed in the transport roller 60 senses the pattern of an encoder disc 61 rotating with the transport roller 60 by the use of an optical sensor. The rotations of the transport roller 60 and the discharge roller 62 are controlled on the basis of the sensing signal.

Since the spur roller 63 comes into pressed contact with the recording sheet having been subjected to the recording operation, the roller surface thereof is uneven so as not to deteriorate the image recorded on the recording sheet. The spur roller 63 is slidable in the direction in which it is attached to and detached from the discharge roller 62 and is biased by a coil spring so as to be pressed to the discharge roller 62. When the recording sheet goes between the discharge roller 62 and the spur roller 63, the spur roller 63 retreats against the biasing force by the thickness of the recording sheet and nips the recording sheet to press the recording sheet toward the discharge roller 62. Accordingly, the rotary power of the discharge roller 62 is satisfactorily delivered to the recording sheet. The pinch roller is provided relative to the transport roller 60 in the same way, nips the recording sheet to press the recording sheet toward the transport roller 60, and satisfactorily delivers the rotary power of the transport roller 60 to the recording sheet.

FIG. 7 is a block diagram illustrating a configuration of the controller 64 of the multifunction apparatus 1. The controller 64 controls the entire operations of the multifunction apparatus 1 including the printer unit 3 and the scanner unit 2 and includes the main board connected to the flat cable 85. Detailed description on the configuration of the scanner unit 3 will be omitted. As shown in the figure, the controller 64 is formed of a micro computer including a CPU (Central Processing Unit) 65, a ROM (Read Only Memory) 66, a RAM (Random Access Memory) 67, and an EEPROM (Electrically Erasable and Programmable ROM) 68 and is connected to an ASIC (Application Specific Integrated Circuit) 70 through a bus 69.

Programs for controlling the operations of the multifunction apparatus 1 are stored in the ROM 66. The RAM 67 serves as a memory area or a work area for temporarily recording data used for executing the programs. Settings or flags to be retained even after a power supply is turned off are stored in the EEPROM 68.

The ASIC 70 generates a phase exiting signal for electrifying the LF (transport) motor 71 in accordance with a command from the CPU 65, sends the phase exciting signal to a driving circuit 72 of the LF motor 71, and controls the rotation of the LF motor 71 by supplying a driving signal to the LF motor 71 through the driving circuit 72.

The driving circuit 72 drives the LF motor 71 connected to the feed roller 25, the transport roller 60, the discharge roller 62, and the purge mechanism 51 and generates an electrical signal for rotating the LF motor 71 in response to the output signal from the ASIC 70. The LF motor 71 rotates in response to the electrical signal and the rotary power of the LF motor 71 is delivered to the feed roller 25, the transport roller 60, the discharge roller 62, and the purge mechanism 51 through a known driving mechanism including gears or driving shafts.

The ASIC 70 generates a phase exciting signal for electrifying the CR (carriage) motor 73 in accordance with a command from the CPU 65, sends the phase exciting signal to a driving circuit 74 of the CR motor 73, and controls the rotation of the CR motor 73 by supplying the driving signal to the CR motor 73 through the driving circuit 74.

The driving circuit 74 serves to drive the CR motor 73 and generates an electrical signal for rotating the CR motor 73 in response to the output signal from the ASIC 70. The CR motor 73 rotates in response to the electrical signal and the rotary power of the CR motor 73 is delivered to the carriage 38 through the belt driving mechanism 46, thereby allowing the carriage 38 to reciprocate. In this way, the reciprocation of the carriage 38 is controlled by the controller 64.

The driving circuit 75 allows the ink jet recording head to selectively eject each color ink to the recording sheet at a predetermined time and receives the output signal generated by the ASIC 75 to control the driving of the ink jet recording head 39, on the basis of the driving control procedure output from the CPU 65. The driving circuit 75 is mounted on the head control board and a signal is supplied to the head control board from the main board constituting the controller 64 through the flat cable 85.

The rotary encoder 76 for detecting the amount of rotation of the transport roller 60 and the linear encoder 77 for detecting the position of the carriage 38 are connected to the ASIC 70. The carriage 38 moves to one end of the guide rails 43 and 44 at the time of turning on the multifunction apparatus 1, thereby initializing the detection position of the linear encoder 77. When the carriage 38 moves over the guide rails 43 and 44 from the initial position, the optical sensor 35 provided in the carriage 38 detects the pattern of the encoder strip 50 and the number of pulses based thereon is acquired as the amount of movement of the carriage 38 by the controller 64. The controller 64 controls the rotation of the CR motor 73 so as to control the reciprocation of the carriage 38 on the basis of the amount of movement.

The operation panel 4 for giving an instruction for operating the scanner unit 3 or the multifunction apparatus 1, the slot unit 5 into which a variety of small-sized memory cards are loaded, and a parallel interface 78 and a USB interface 79 for transmitting and receiving data to and from an external information instrument such as a personal computer through a parallel cable or a USB cable are connected to the ASIC 70. an NCU (Network Control Unit) 80 or a MODEM 81 for performing a facsimile function is also connected thereto.

Figure 9:
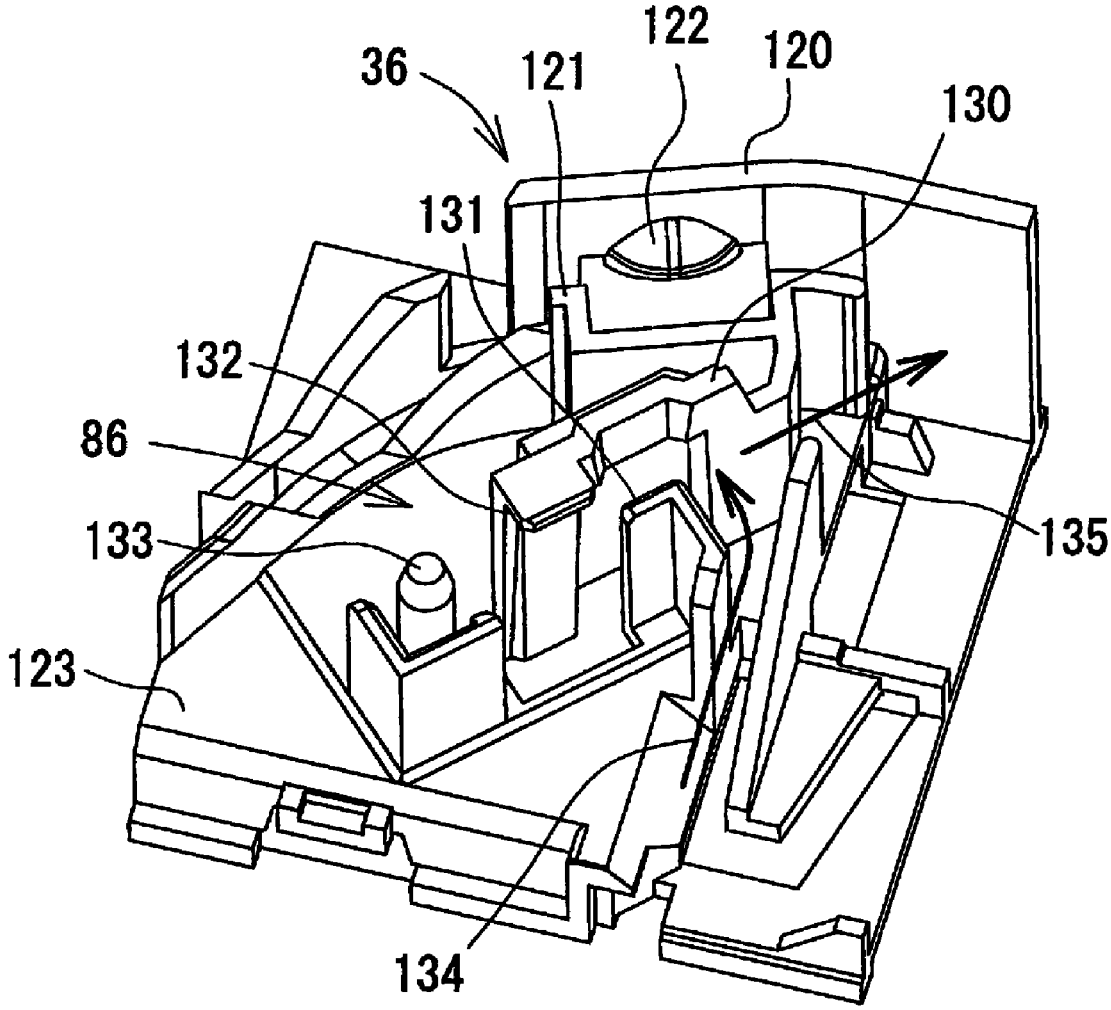
FIG. 9 is an enlarged perspective view illustrating configurations of fixing clips.

The configuration of the fixing clips 36 and 86 and the peripheral configuration thereof will be described in detail now. FIG. 9 is an enlarged perspective view illustrating the fixing clips 36 and 86 as viewed in the direction of arrow 101 in FIG. 4. The ink tubes 41 and the flat cable 85 are omitted in FIG. 9.

As shown in FIG. 9, the fixing clip 36 includes a pair of vertical walls 120 and 121 opposed to each other with a gap substantially equal to the outer diameter of the ink tubes 41 and a protruding piece 122 protruding from a predetermined height position of the wall 120 toward the wall 121. The walls 120 and 121 rise upright from a board 123. The board 123 is fixed to the apparatus body close to the supporting board 110 as shown in FIG. 4. Four ink tubes 41 are vertically arranged and interposed between the pair of walls 120 and 121. The protruding piece 122 is disposed at a position having a height of four times the outer diameter of the ink tubes 41 from the board 123, that is, at a position coming into contact with the top surface of the uppermost ink tube 41 among the four ink tubes 41 arranged in the vertical direction. The four ink tubes 41 inserted between the pair of walls 120 and 121 are prevented from departing from the walls 120 and 121 because they are pressed by the protruding piece 122.

As shown in FIG. 4, the fixing clip 36 is disposed substantially at the center in the width direction of the apparatus. Accordingly, it is possible to reduce the length of the ink tubes 41 drawn out to the carriage 38 from the fixing clip 36 so as to follow the carriage reciprocating in the width direction. The pair of walls 120 and 121 fixes the ink tubes 41 so as to draw out the ink tubes toward the regulating wall 37. That is, the vertical wall surface of the regulating wall 37 and the direction in which the fixing clip 36 draws out the ink tubes 41, that is, the wall surfaces of the pair of walls 120 and 121 form an obtuse angle smaller than 180° in a plan view. Since the ink tubes 41 has a flexibility and an appropriate elasticity (bending strength), the ink tubes extend to have an angle about the regulating wall 37 by means of the fixing clip 36 and thus are pressed to the wall surface of the regulating wall 37. Accordingly, the range in which the ink tubes 41 are regulated along the regulating wall 37 increases in the reciprocation range of the carriage 38, thereby reducing the range in which the portions of the ink tubes 41 from the curved portion to the carriage 38 swells toward the rear side of the apparatus, in other words, toward the carriage 38.

As shown in FIG. 9, the fixing clip 86 includes a pair of vertical walls 130 and 131 opposed to each other with a gap substantially several times larger than the thickness of the flat cable 85, a protruding piece 132 protruding from the top end of the wall 130 toward the wall 131, and a pin 133 disposed apart from the walls 130 and 131 to the opposite side of the regulating wall 37. The walls 130 and 131 rise upright from the board 123. The flat cable 85 is pressed and inserted between the pair of walls 130 and 131 in the state where the flat cable 85 is bent oppositely with the front and rear surfaces thereof extend vertically and is fixed with a predetermined posture. When a plurality of flat cables 85 is provided, they are bent oppositely as a whole and pressed between the walls 130 and 131. Accordingly, the distance between the wall 130 and 131 is set depending on the number of flat cables 85 to be pressed and inserted and the thickness thereof.

The protruding piece 132 is disposed at a position having a height equal to the width of the front and rear surfaces of the flat cable 85 from the board 123. The protruding piece 132 comes into contact with the top end of the flat cable 85 pressed and inserted between the walls 130 and 131, thereby preventing the flat cable 85 from departing from the walls 130 and 131.

The pin 133 has a rod shape rising upright from the board 123 and has a height equal to the width of the front and rear surfaces of the flat cable 85. The portion of the flat cable 85 pressed and inserted between the walls 130 and 131 and bent oppositely is wound on the pin 133. The flat cable 85 of the side connected to the main board passes between the walls 130 and 131, is wound on the pin 133, and then is bent oppositely. The flat cable 85 further passes through the walls 130 and 131 and extends as indicated by arrow 135. The flat cable 85 is drawn out to be horizontally curved in a U shape, is fixed to the carriage 38, and is connected to the head control board.

As shown in FIG. 4, the fixing clip 86 is disposed substantially at the center in the width direction of the machine. Accordingly, it is possible to reduce the length of the flat cable 85 drawn out to the carriage 38 from the fixing clip 86 so as to follow the carriage reciprocating in the width direction. The pair of walls 130 and 131 fixes the flat cable 85 so as to draw out the ink tubes toward the regulating wall 37. That is, the vertical wall surface of the regulating wall 37 and the direction in which the fixing clip 86 draws out the flat cable 85, that is, the wall surfaces of the pair of walls 130 and 131 form an obtuse angle smaller than 180° in a plan view. Since the flat cable 85 has a flexibility and an appropriate elasticity (bending strength), the ink tubes extend to have an angle about the regulating wall 37 by means of the fixing clip 86 and thus are pressed toward the wall surface of the regulating wall 37. Accordingly, the range in which the flat cable 85 is controlled along the regulating wall 37 increases in the reciprocation range of the carriage 38, thereby reducing the range in which the portions of the flat cable 85 from the curved portion to the carriage 38 swells to the rear side of the machine, in other words, toward the carriage 38.

Figure 10:
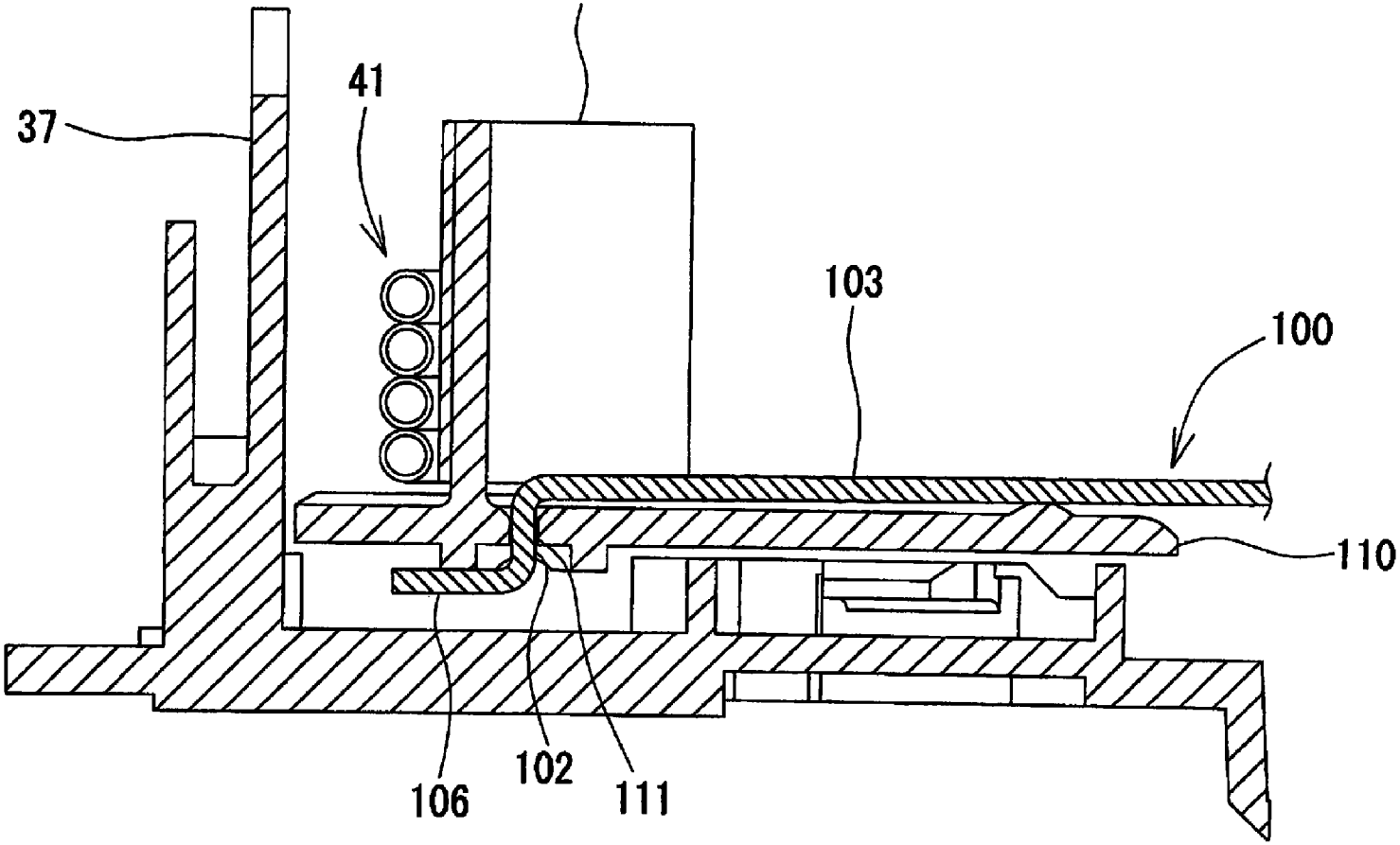
FIG. 10 is a cross-sectional view taken along Line X-X of FIG. 11.

As shown in FIGS. 4 and 10, a glide wall 140 (regulating member) rises upright in the vicinity of the pivot hole 111 of the supporting board 110 with a distance therebetween from the regulating wall 37 toward the carriage 38. The guide wall 140 is formed only in a predetermined range in the vicinity of the pivot hole 111 and comes into contact with the inside of the curved portion of the flat cable 85 when the carriage 38 moves so as to enlarge the U-shaped curved portion of the flat cable 85 (see FIG. 11). The ink tubes 41 and the flat cable 85 are inserted between the guide wall 140 and the regulating wall 37 and are prevented from being bent toward the carriage 38 from the fixing clip 36 or the fixing clip 86 by coming into contact with the guide wall 140. Accordingly, it is possible to direct the center of the U-shaped curved portion toward the regulating wall 37 without forming a buckle in the ink tubes 41 and the flat cable 85. Accordingly, the enlargement of the curved portion of the ink tubes 41 and the flat cable 85 is prevented, the movement of the ink tubes 41 and the flat cable 85 toward the carriage 38 is prevented, and the lengths of the ink tubes 41 and the flat cable 85 from the fixing clip 36 or the fixing clip 86 to the carriage 38 can be made the smallest.

Now, operations of the ink tubes 41, the flat cable 85, and the swingable support member 100 during the image recording operation of the printer unit 2 will be described. The carriage 38 mounted with the recording head 39 is supplied with the driving force of the CR motor 73 through the belt driving mechanism 46 and is guided by the guide rails 43 and 44, thereby reciprocating in the direction perpendicular to the transport direction of the recording sheet. The recording head 39 ejects the respective color ink supplied through the ink tubes 41 to the recording sheet on the platen 42 at a predetermined time, on the basis of the signal transmitted through the flat cable 85 from the controller 64. By repeating the intermittent transport of the recording sheet by means of the transport roller 60 and the discharge roller 62 and the reciprocation of the carriage 38, a desired image is recorded on the recording sheet.

Figure 11:
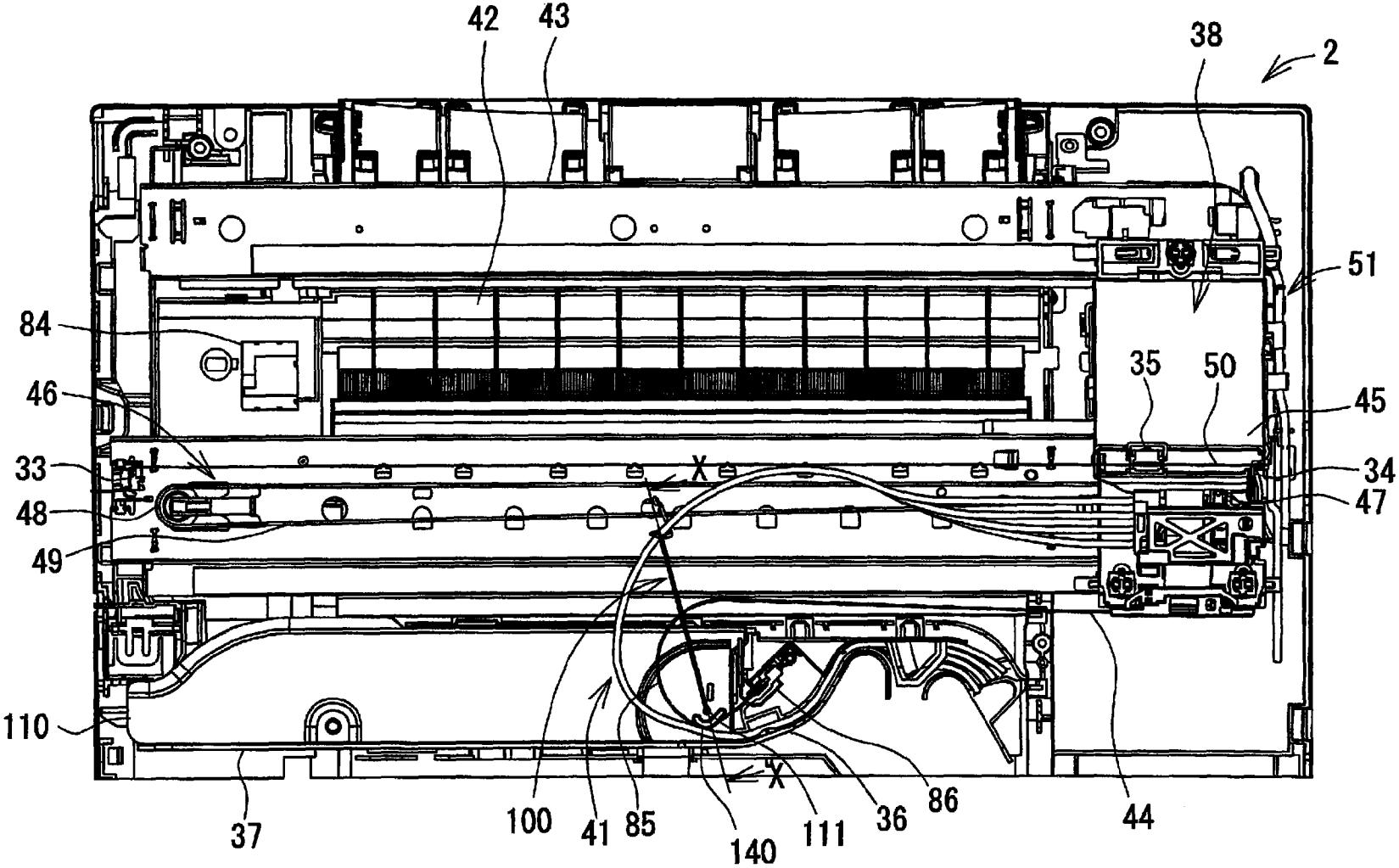
FIG. 11 is a plan view illustrating a partial configuration of the printer unit.
Figure 12:
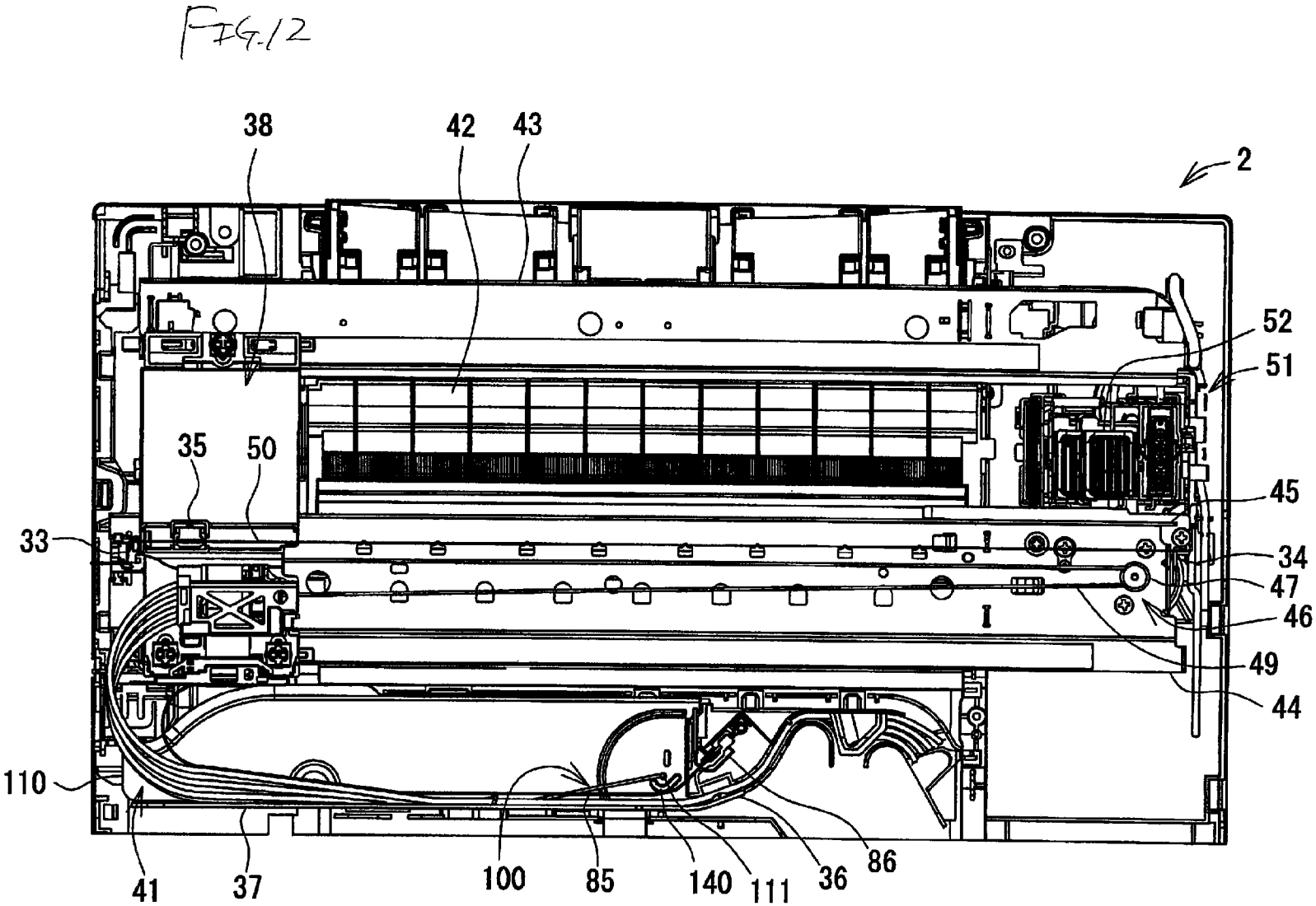
FIG. 12 is a plan view illustrating a partial configuration of the printer unit.
Figure 13:
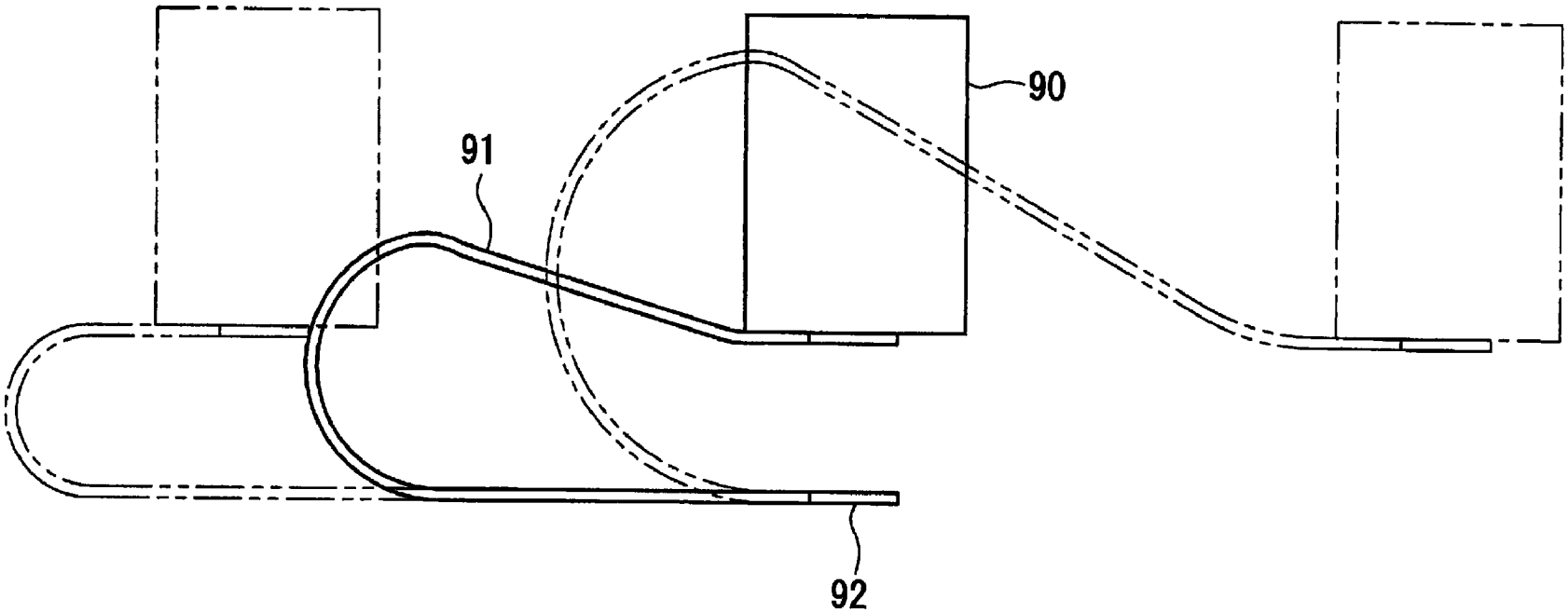
FIG. 13 is a schematic diagram illustrating a carriage and a flat cable of a conventional image recording apparatus.

The ink tubes 41 and the flat cable 85 of which the ends are connected to the carriage 38 changes the postures thereof while varying the curvature of the U-shaped curved portion with the reciprocation of the carriage 38. FIG. 11 is a diagram illustrating a case where the carriage 38 is located at a capping position (the right side in the figure) on the cap 52 and FIG. 12 is a diagram illustrating a case where the carriage 38 is located at a flushing position (the left side in the figure) on the waste ink tray 84. In this aspect, the capping position is the initial position of the carriage 38.

As shown in FIG. 11, when the carriage 38 is located at the capping position, the ink tubes 41 and the flat cable 85 form the U shape which extends toward the flushing position in the reciprocation direction of the carriage 38 from the fixing clips 36 and 86 and which is inverted right. The ink tubes 41 and the flat cable 85 have a flexibility and a certain degree of bending strength. The U-shaped curved portions of the ink tubes 41 and the flat cable 85 tend to swell above the guide rail 44 due to the elasticity, but come into contact with the wall surface of the guide wall 140 and is prevented from being bent at an acute angle from the fixing clips 36 and 86 to the carriage 38. In addition, the center of the U-shaped curved portion becomes closer to the regulating wall 37. Accordingly, since the enlargement of the curved portions of the ink tubes 41 and the flat cable 85 is prevented, their movement in the direction closer to the carriage 38 can be restricted and the space for drawing out the ink tubes 41 and the flat cable 85 can be reduced, thereby reducing the size of the machine. The lengths of the ink tubes 41 and the flat cables 85 from the fixing clips 36 and 86 to the carriage 38 can be made the smallest.

As shown in FIG. 4, when the carriage 38 slides from the capping position to the flushing position, the ink tubes 41 and the flat cable 85 move following the carriage 38 while changing their postures so as to reduce the diameter of the U-shaped curved portion. As shown in FIG. 12, when the carriage 38 is located at the flushing position, the diameters of the U-shaped curved portions of the ink tubes 41 and the flat cable 85 are the smallest. Since the fixing clips 36 and 86 fixes the ink tubes 41 and the flat cable 85 so as to press them to the wall surface of the regulating wall 37, the ink tubes 41 and the flat cable 85 are controlled to actively come in contact with the regulating wall 37 in the reciprocation range of the carriage 38 and thus the curved portions of the ink tubes 41 and the flat cable 85 which are non-fixed portions are prevented from moving toward the carriage 38. Accordingly, the portions extending along the wall surface of the regulating wall 37 among the non-fixed portions of the ink tubes 41 and the flat cable 85 are prevented from being away from the regulating wall 37. Therefore, since the range in which the ink tubes 41 and the flat cable 85 swell to the carriage 38 is reduced and the swelling away from the carriage 38 is prevented by the regulating wall 37, the space for arranging the ink tubes 41 and the flat cable 85 is reduced.

According to the multifunction apparatus 1, the fixing clip 86 fixing the flat cable 85 to press the flat cable to the regulating wall 37 applies a force for moving the curved portion to the regulating wall 37 on the flat cable 85 toward the flushing position in the reciprocation of the carriage 38, that is, in the direction in which the non-fixed portion of the flat cable 85 comes in contact with the regulating wall 37, thereby reducing the curvature of the curved portion and preventing the curved portion from moving toward the carriage 38. The flat cable 85 is prevented from swelling in the direction getting away from the carriage 38 by the regulating wall 37.

Toward the capping position in the reciprocation of the carriage 38, that is, in the direction in which the curvature of the curved portion of the flat cable 85 increases, the flat cable 85 extending from the fixing clip 86 is suppressed from moving in the direction getting closer to the carriage 38 from a predetermined position by the guide wall 140 disposed to come in contact with the inside of the curved portion of the flat cable 85 in the vicinity of the fixing clip 86. Accordingly, in the entire reciprocation range of the carriage 38, since the movable range of the flat cable 85 is suppressed within a predetermined range, it is prevented that the flat cable 85 moves and comes in contact with other members to buckle, wear, or damage the flat cable 85.

In this aspect, the flat cable 85 is fixed to the fixing clip 86, but the shape of the fixing member is not limited to the clip shape but the fixing member may have any shape if it can only fix the flat cable 85 as a conductive wire.

What is claimed is:

1. An image recording apparatus comprising:

a recording head which records an image on a recording medium by ejecting ink droplets;

a carriage which is mounted with the recording head and reciprocates in a reciprocation direction intersecting a transport direction of the recording medium;

a conductive wire having flexibility capable of changing its posture in accordance with reciprocation of the carriage, one end side of the conductive wire being fixed to the carriage and the conductive wire extending from the carriage, the conductive wire transmitting a recording signal to the recording head;

a regulating wall which extends along the reciprocation direction of the carriage and suppresses the conductive wire from swelling in a direction separating away from the carriage; and a fixing member which fixes other end side of the conductive wire to an apparatus body by forming a curved portion inverted in the reciprocation direction of the carriage at a predetermined position between the regulating wall and the carriage in the conductive wire and pressing the other end side of the conductive wire toward the regulating wall.

2. The image recording apparatus according to claim 1, wherein the fixing member is located substantially at center of a movable range of the carriage.

3. The image recording apparatus according to claim 1, further comprising an ink supply tube having flexibility capable of changing its posture in accordance with the reciprocation of the carriage and supplying ink to the recording head, the ink supply tube forming a curved portion inverted in the reciprocation direction of the carriage outside the curved portion of the conductive wire, wherein the conductive wire is suppressed from swelling in the direction separating away from the carriage by the regulating wall with the ink supply tube interposed therebetween.

4. An image recording apparatus comprising:

a recording head which records an image on a recording medium by ejecting ink droplets;

a carriage which is mounted with the recording head and reciprocates in a reciprocation direction intersecting a transport direction of the recording medium;

a conductive wire having flexibility capable of changing its posture in accordance with reciprocation of the carriage, one end side of the conductive wire being fixed to the carriage and the conductive wire extending from the carriage, the conductive wire transmits a recording signal to the recording head;

a fixing member which fixes other end side of the conductive wire to an apparatus body by forming a curved portion inverted in the reciprocation direction of the carriage in the conductive wire; and a regulating member which comes into contact with an inside of the curved portion of the conductive wire in vicinity of the fixing member and suppresses the other end side of the conductive wire from moving from a predetermined position in a direction approaching toward the carriage.

5. The image recording apparatus according to claim 4, wherein the fixing member is located substantially at center of a movable range of the carriage.

6. An image recording apparatus comprising:

a recording head which records an image on a recording medium by ejecting ink droplets;

a carriage which is mounted with the recording head and reciprocates in a reciprocation direction intersecting a transport direction of the recording medium;

a conductive wire having flexibility capable of changing its posture in accordance with reciprocation of the carriage, one end side of the conductive wire being fixed to the carriage and the conductive wire extending from the carriage, the conductive wire transmitting a recording signal to the recording head;

a regulating wall which extends along the reciprocation direction of the carriage and suppresses the conductive wire from swelling in a direction separating away from the carriage;

a fixing member which fixes other end side of the conductive wire to an apparatus body by forming a curved portion inverted in the reciprocation direction of the carriage at a predetermined position between the regulating wall and the carriage in the conductive wire and pressing the other end side of the conductive wire toward the regulating wall; and a regulating member which comes into contact with an inside of the curved portion of the conductive wire in vicinity of the fixing member and suppresses the other end side of the conductive wire from moving from a predetermined position in a direction approaching toward the carriage.

7. The image recording apparatus according to claim 6, wherein the fixing member is located substantially at center of a movable range of the carriage.

* * * * *